US008980522B2

(12) United States Patent
Mizuhata

(10) Patent No.: US 8,980,522 B2
(45) Date of Patent: Mar. 17, 2015

(54) METHOD FOR PRODUCING ELECTROSTATIC LATENT IMAGE DEVELOPING TONER

(75) Inventor: Hiroshi Mizuhata, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/996,210

(22) PCT Filed: Dec. 21, 2011

(86) PCT No.: PCT/JP2011/079643
§ 371 (c)(1),
(2), (4) Date: Aug. 12, 2013

(87) PCT Pub. No.: WO2012/086688
PCT Pub. Date: Jun. 28, 2012

(65) Prior Publication Data

US 2013/0316284 A1 Nov. 28, 2013

(30) Foreign Application Priority Data

Dec. 22, 2010 (JP) ..... 2010-286720

(51) Int. Cl.
*G03G 9/087* (2006.01)
*G03G 9/08* (2006.01)

(52) U.S. Cl.
CPC ..... *G03G 9/0802* (2013.01); *G03G 9/0804* (2013.01); *G03G 9/08755* (2013.01); *G03G 9/08797* (2013.01)
USPC ..... 430/137.14

(58) Field of Classification Search
CPC ..... G03G 9/0804
USPC ..... 430/137.14
See application file for complete search history.

(56) References Cited

U.S. PATENT DOCUMENTS

| | | | | |
|---|---|---|---|---|
| 5,416,166 | A | 5/1995 | Yoo et al. | |
| 5,916,725 | A | 6/1999 | Patel et al. | |
| 5,945,245 | A | 8/1999 | Mychajlowskij et al. | |
| 6,352,810 | B1 * | 3/2002 | Jiang et al. | 430/137.11 |
| 2006/0105261 | A1 | 5/2006 | Keoshkerian et al. | |
| 2008/0199802 | A1 | 8/2008 | Keoshkerian et al. | |
| 2008/0213687 | A1 | 9/2008 | Keoshkerian et al. | |
| 2012/0251940 | A1 | 10/2012 | Suzuki et al. | |

FOREIGN PATENT DOCUMENTS

| | | |
|---|---|---|
| JP | 6 506261 | 7/1994 |
| JP | 8 20636 | 1/1996 |
| JP | 10 239903 | 9/1998 |
| JP | 11 133668 | 5/1999 |
| JP | 11 258851 | 9/1999 |
| JP | 11 258854 | 9/1999 |
| JP | 2003 316068 | 11/2003 |
| JP | 2006 146222 | 6/2006 |
| JP | 2009 128908 | 6/2009 |
| JP | 2011 133534 | 7/2011 |

OTHER PUBLICATIONS

American Chemical Society (ACS) File Registry No. RN 21120-99-0 on STN, copyright 2014, which was entered in STN on Nov. 16, 1984.*

International Search Report Issued Feb. 14, 2012 in PCT/JP11/79643 Filed Dec. 21, 2011.

Computer generated English-language translation of JP 2007-108458.

* cited by examiner

*Primary Examiner* — Janis L Dote

(74) *Attorney, Agent, or Firm* — Oblon, McClelland, Maier & Neustadt, L.L.P.

(57) ABSTRACT

The present invention relates to a process for producing a toner for development of electrostatic latent images which includes a step (1) of mixing and aggregating resin particles (A), releasing agent particles and an aggregating agent formed of a divalent to pentavalent amine salt in an aqueous medium to obtain aggregated particles, and a toner for development of electrostatic latent images obtained by the process.

19 Claims, No Drawings

METHOD FOR PRODUCING ELECTROSTATIC LATENT IMAGE DEVELOPING TONER

TECHNICAL FIELD

The present invention relates to a process for producing a toner for development of electrostatic latent images, and a toner for development of electrostatic latent images obtained by the process.

BACKGROUND ART

In the field of toners for development of electrostatic latent images, with the progress of electrophotographic systems, it has been demanded to develop toners adaptable for high image quality and high copying speed.

In view of the high image quality and high copying speed, the toners are required to have various excellent properties. To meet these requirements for the toners, as a method of optionally controlling a particle size and surface properties of the toners, there has been proposed a process for producing a toner by an aggregating and unifying method (emulsification/aggregation method or aggregation/fusion method) in which a colorant, resin particles, etc., are aggregated by salting-out or the like method and fused together to obtain a single toner particle.

For example, Patent Document 1 discloses a process for producing a toner which includes a step of emulsifying a resin binder containing a polyester in an aqueous medium and a step of adding a water-soluble nitrogen-containing compound having a molecular weight of 350 or less to an emulsion of the resin binder obtained in the previous step to aggregate the emulsified particles, for the purpose of obtaining a toner having a narrow particle size distribution.

Patent Document 2 discloses a process for producing a toner which includes a step of fusing resin particles and colorant particles in the presence of a polymeric aggregating agent in an aqueous medium, for the purpose of obtaining a toner capable of stably forming images having a high image quality.

Patent Document 3 discloses a process for producing a developer which includes a step of adding a cationic organic coagulant having an average molecular weight of from 1,000 to 100,000 to a dispersion of fine particles as a mixture containing a resin binder and a colorant to aggregate the fine particles in the mixture and thereby form aggregated particles, for the purpose of obtaining a developer having good charging property and low-temperature fusing property which can be formed into finer particles.

CITATION LIST

Patent Literature

[Patent Document 1]: JP 2007-108458A
[Patent Document 2]: JP 2003-316068A
[Patent Document 3]: JP 2009-128908A

SUMMARY OF INVENTION

Technical Problem

When using a releasing agent upon production of a toner, it is possible to improve a fusing property of the resulting toner owing to melting characteristics of the releasing agent. However, the releasing agent tends to have a less compatibility with a resin binder and a colorant contained in the toner. Therefore, it is considered that in the case where the toner is produced by an aggregation/fusion method, there occurs such a problem that the releasing agent is isolated from the toner or exposed to a surface of the toner owing to heat generated upon the fusion, which may result in deteriorated charging property. In order to prevent exposure of the releasing agent, there has been proposed a method of forming a shell layer on the toner by a multi-stage emulsification/aggregation method. However, such a method is still insufficient to overcome the above problems.

An object of the present invention is to provide a toner for development of electrostatic latent images which is excellent in low-temperature fusing property and charging property, and a process for producing the toner.

Solution to Problem

The present inventors have considered that positions of the releasing agent in the toner obtained by an aggregation/fusion method as well as surface conditions of the toner have large influences on a low-temperature fusing property and a charging property of the toner, and have made various studies and researches. As a result, it has been found that by conducting a production process including a step of mixing and aggregating resin particles, releasing agent particles and a specific aggregating agent in an aqueous medium to obtain aggregated particles, it is possible to obtain a toner for development of electrostatic latent images which is excellent in low-temperature fusing property and charging property.

That is, the present invention relates to the following aspects [1] and [2].

[1] A process for producing a toner for development of electrostatic latent images, including a step (1) of mixing and aggregating resin particles (A), releasing agent particles and an aggregating agent formed of a divalent to pentavalent amine salt in an aqueous medium to obtain aggregated particles (1).

[2] A toner for development of electrostatic latent images produced by the process as described in the above aspect [1].

Advantageous Effects of Invention

According to the present invention, there is provided a toner for development of electrostatic latent images which is excellent in low-temperature fusing property and charging property, and a process for producing the toner.

DESCRIPTION OF EMBODIMENTS

[Process for Producing Toner for Development of Electrostatic Latent Images]

The process for producing a toner for development of electrostatic latent images according to the present invention includes a step (1) of mixing and aggregating resin particles (A), releasing agent particles and an aggregating agent formed of a divalent to pentavalent amine salt in an aqueous medium to obtain aggregated particles (1).

The reason why the toner for development of electrostatic latent images obtained by the production process of the present invention is excellent in low-temperature fusing property and charging property is considered as follows, although it is not clearly determined.

In the present invention, in the case where the resin particles (A) and the releasing agent particles are aggregated with each other to obtain aggregated particles, the divalent to pentavalent amine salt is used as an aggregating agent. The use of such a polyvalent aggregating agent enables aggregation of the particles even when the aggregating agent is used in a very small amount. For this reason, it is considered that when the aggregated particles are fused in the subsequent step, the fusion between the particles can be efficiently carried out, and the resulting fused particles can exhibit a uniform and smooth surface configuration. As a result, since the releasing agent contained in the respective releasing agent particles is incorporated in the toner, it is suggested that the obtained toner can be improved in charging property, so that an optical density of printed images and scattering of the toner in the device (toner cloud) can be improved.

In particular, in the case where the divalent to pentavalent amine salt is used as the aggregating agent, it is possible to prevent increase in softening point of the resin owing to metal-crosslinking thereof which is considered to occur in the aggregating agent remaining in the toner upon using an inorganic aggregating agent such as calcium chloride. As a result, it is considered that the toner can be readily fused and fixed even at a low temperature upon printing, i.e., the resulting toner is excellent in low-temperature fusing property.

In the following, the respective components used in the present invention are first explained.

(Resin Particles (A))

In the present invention, the resin constituting the resin particles (A) preferably contains a polyester resin (a) from the viewpoint of attaining both an excellent low-temperature fusing property and an excellent heat-resistant storage stability of the resulting toner.

The content of the polyester resin (a) in the resin particles (A) is preferably from 50 to 100% by weight, more preferably from 80 to 100% by weight, still more preferably from 90 to 100% by weight and especially preferably substantially 100% by weight on the basis of the weight of the resin constituting the resin particles (A) from the viewpoint of enhancing a low-temperature fusing property of the resulting toner.

<Polyester Resin (a)>

The polyester resin (a) used in the present invention may be either a non-crystalline polyester or a crystalline polyester, or may be a mixture of these polyesters. From the viewpoints of enhancing a low-temperature fusing property, a heat-resistant storage stability and a charging property of the resulting toner and preventing occurrence of hot offset of the toner, the content of the non-crystalline polyester in the polyester resin (a) is preferably from 70 to 100% by weight, more preferably from 90 to 100% by weight and especially preferably substantially 100% by weight.

Meanwhile, the non-crystalline polyester means those polyesters having a crystallinity index of more than 1.4 or less than 0.6 wherein the crystallinity index is defined by a ratio of a softening point to an endothermic maximum peak temperature as measured by a differential scanning colorimeter (DSC), i.e., "softening point (° C.)/endothermic maximum peak temperature (° C.)", whereas the crystalline polyester means those polyesters having a crystallinity index of from 0.6 to 1.4.

In the present invention, the crystallinity index of the polyester resin (a) is preferably less than 0.6 or more than 1.4 but not more than 4, more preferably less than 0.6 or not less than 1.5 but not more than 4, still more preferably less than 0.6 or not less than 1.5 but not more than 3, and especially preferably less than 0.6 or not less than 1.5 but not more than 2 from the viewpoints of enhancing a charging property and a durability of the resulting toner and further enhancing a heat-resistant storage stability and a low-temperature fusing property of the toner. The crystallinity index of the polyester resin (a) may be appropriately determined by controlling kinds and proportions of raw monomers used, production conditions, for example, reaction temperature, reaction time and cooling rate, or the like.

The polyester resin (a) is preferably a polyester containing an acid group at a terminal end of a molecule thereof from the viewpoints of facilitating emulsification of a dispersion of the resin particles and enhancing a stability of the dispersion. Examples of the acid group include a carboxyl group, a sulfonic group, a phosphonic group and a sulfinic group. Among these acid groups, preferred is a carboxyl group from the viewpoint of promoting emulsification of the polyester.

The polyester resin (a) may be produced by subjecting a carboxylic acid component and an alcohol component to polycondensation reaction. The polycondensation reaction is preferably carried out at a temperature of from 140 to 200° C. in the presence of a catalyst.

Examples of the carboxylic acid component include dicarboxylic acids, trivalent or higher-valent polycarboxylic acids, and anhydrides and alkyl ($C_1$ to $C_3$) esters of these acids. Among these carboxylic acid components, preferred are dicarboxylic acids.

Specific examples of the dicarboxylic acids include phthalic acid, isophthalic acid, terephthalic acid, sebacic acid, fumaric acid, maleic acid, adipic acid, azelaic acid, succinic acid, cyclohexanedicarboxylic acid, and succinic acids substituted with an alkyl group having 1 to 20 carbon atoms or an alkenyl group having 2 to 20 carbon atoms. Among these dicarboxylic acids, preferred is terephthalic acid from the viewpoint of enhancing a charging property of the resulting toner.

Specific examples of the succinic acids substituted with an alkyl group having 1 to 20 carbon atoms or an alkenyl group having 2 to 20 carbon atoms include dodecylsuccinic acid, dodecenylsuccinic acid and octenylsuccinic acid.

Specific examples of the trivalent or higher-valent polycarboxylic acids include trimellitic acid, 2,5,7-naphthalene-tricarboxylic acid and pyromellitic acid. Among these polycarboxylic acids, preferred are trimellitic acid and trimellitic anhydride from the viewpoint of enhancing an anti-offset property of the resulting toner.

These carboxylic acid components may be used alone or in combination of any two or more thereof.

The polyester resin (a) preferably contains at least one polyester resin obtained by using an acid component containing a trivalent or higher-valent polycarboxylic acid or an anhydride or alkyl ester thereof, preferably trimellitic acid or trimellitic anhydride, from the viewpoint of enhancing an anti-offset property of the resulting toner.

Examples of the alcohol component include aromatic diols, aliphatic diols having 2 to 12 carbon atoms, hydrogenated products of bisphenol A and trivalent or higher-valent polyhydric alcohols. Among these alcohol components, preferred are aromatic diols from the viewpoints of obtaining a non-crystalline polyester and enhancing a charging property of the resulting toner.

Preferred examples of the aromatic diols include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane.

Examples of the aliphatic diols having 2 to 12 carbon atoms include α,ω-linear alkanediols. Specific examples of the α,ω-linear alkanediols include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol and 1,12-dodecanediol.

Specific examples of the other aliphatic diols having 2 to 12 carbon atoms include neopentyl glycol and 1,4-butenediol.

These alcohol components may be used alone or in combination of any two or more thereof.

From the viewpoint of a high efficiency of the polycondensation reaction, as the catalyst, there are preferably used tin compounds and titanium compounds, more preferably tin compounds, and still more preferably tin di(2-ethyl hexanoate) and dibutyl tin oxide. Examples of the titanium compounds include titanium diisopropylate bistriethanol aminate and the like.

The amount of the catalyst used is preferably from 0.01 to 1 part by weight and more preferably from 0.1 to 0.6 parts by weight on the basis of 100 parts by weight of a total amount of the acid component and the alcohol component.

The polycondensation reaction is preferably carried out by charging the acid component, the alcohol component and the catalyst into a reaction vessel and maintaining the contents of the reaction vessel at a temperature of from 140 to 200° C. for 5 to 15 hours. Further, the reaction pressure is then reduced to 5.0 to 20 kPa under which the reaction solution is maintained for 1 to 10 hours.

The glass transition point of the polyester resin (a) is preferably from 55 to 75° C., more preferably from 55 to 70° C. and still more preferably from 58 to 68° C. from the viewpoint of enhancing a durability, a low-temperature fusing property and a storage stability of the resulting toner.

The softening point of the polyester resin (a) is preferably from 70 to 165° C., more preferably from 70 to 140° C., still more preferably from 90 to 140° C. and especially preferably from 100 to 130° C. from the same viewpoint as described above.

Meanwhile, in the case where the polyester resin (a) is in the form of a mixture of two or more kinds of polyester resins, the glass transition point and softening point of the polyester resin (a) are respectively determined from the values of a glass transition point and a softening point of the mixture of two or more kind of polyester resins as measured according to the method described in Examples below.

The number-average molecular weight of the polyester resin (a) is preferably from 1,000 to 50,000, more preferably from 1,000 to 10,000 and still more preferably from 2,000 to 8,000 from the viewpoint of enhancing a durability, a low-temperature fusing property and a storage stability of the resulting toner.

The acid value of the polyester resin (a) is preferably from 6 to 35 mgKOH/g, more preferably from 10 to 35 mgKOH/g and still more preferably from 15 to 35 mgKOH/g from the viewpoint of facilitating emulsification of the resin in an aqueous medium.

From the viewpoint of enhancing a low-temperature fusing property, an anti-offset property and a durability of the resulting toner, the polyester resin (a) preferably contains two kinds of polyesters which are different in softening point from each other. When using two kinds of polyesters (a-1) and (a-2) which are different in softening point from each other, one polyester (a-1) preferably has a softening point of not lower than 70° C. and lower than 115° C., whereas the other polyester (a-2) preferably has a softening point of not lower than 115° C. and not higher than 165° C. The weight ratio of the polyester (a-1) to the polyester (a-2) ((a-1)/(a-2)) in the polyester resin (a) is preferably from 10/90 to 90/10 and more preferably from 50/50 to 90/10.

The resin particles (A) may also contain resins other than the polyester resin (a) unless the aimed effects of the present invention are adversely influenced. Examples of the other resins include styrene-acryl copolymers, epoxy resins, polycarbonates and polyurethanes.

In addition, the resin particles (A) may also contain a releasing agent and an antistatic agent unless the aimed effects of the present invention are adversely influenced. Further, the resin particles (A) may also contain other additives such as a reinforcing filler such as fibrous substances, an antioxidant and an anti-aging agent, if required.

The resin particles (A) may be in the form of either particles of resins solely or colorant-containing resin particles. From the viewpoints of readily controlling aggregation of the resin particles to suppress formation of coarse particles upon the aggregation, and enhancing an optical density of the resulting printed images, the resin particles (A) preferably contain a colorant, i.e., are preferably in the form of colorant-containing resin particles.

In the case where the resin particles are in the form of particles of resins solely, it is preferred that colorant particles obtained by surface-treating a colorant or using a dispersant, or colorant-containing resin particles obtained by incorporating the colorant into resin particles are additionally used in the step (2) described in detail below.

The content of the colorant in the resin particles (A) when the resin particles (A) are used in the form of colorant-containing resin particles is preferably from 1 to 20 parts by weight and more preferably from 5 to 10 parts by weight on the basis of 100 parts by weight of the resins constituting the colorant-containing resin particles from the viewpoint of enhancing an optical density of printed images produced using the toner.

<Colorant>

The colorant used in the toner of the present invention may be either a pigment or a dye. From the viewpoint of enhancing an optical density of printed images produced using the toner, the pigment is preferably used.

Examples of the pigment include a cyan pigment, a yellow pigment, a magenta pigment and a black pigment.

Preferred examples of the cyan pigment include a phthalocyanine pigment, and more preferred is copper phthalocyanine. Preferred examples of the yellow pigment include a monoazo pigment, an isoindoline pigment and a benzimidazolone pigment. Preferred examples of the magenta pigment include a quinacridone pigment, a soluble azo pigment such as a BONA lake pigment and an insoluble azo pigment such as a naphthol AS pigment. Preferred examples of the black pigment include carbon blacks.

Specific examples of the pigment include carbon blacks, inorganic composite oxides, Chrome Yellow, Benzidine Yellow, Brilliant Carmine 3B, Brilliant Carmine 6B, red iron oxide, Aniline Blue, ultramarine blue, copper phthalocyanine and Phthalocyanine Green.

Specific examples of the dye include acridine dyes, azo dyes, benzoquinone dyes, azine dyes, anthraquinone dyes, indigo dyes, phthalocyanine dyes and Aniline Black dyes.

These colorants may be used alone or in combination of any two or more thereof.

<Production of Resin Particles (A)>

The resin particles (A) are preferably produced by the method in which the resin component containing 90% by weight or more of the polyester resin (a) and the aforementioned optional components are dispersed in an aqueous medium to prepare a dispersion containing the resin particles (A).

As the method of obtaining the dispersion, there may be used the method of adding the resins and the like to the aqueous medium and subjecting the resulting mixture to dispersing treatment using a disperser, the method of gradually adding the aqueous medium to the resins and the like to subject the resulting mixture to phase inversion of emulsion, etc. Among these methods, from the viewpoint of enhancing a low-temperature fusing property of the resulting toner, the method using phase inversion of emulsion is preferred. In the following, the method using phase inversion of emulsion is explained.

First, the resin component containing the polyester resin (a), an alkali aqueous solution and the aforementioned optional components are melted and mixed with each other to obtain a resin mixture.

In the case where the resin particles (A) are in the form of colorant-containing resin particles, the colorant is also mixed with the above components to prepare a colored resin mixture.

When the resin component containing the polyester resin (a) contains the other resins, the polyester resin (a) may be previously mixed with the other resins. Alternatively, when adding the alkali aqueous solution and the optional components, the polyester resin (a) and the other resins may be added simultaneously therewith, and melted and mixed with each other. For example, when a plurality of the polyester resins (a) are contained in the resin component, from the viewpoint of enhancing a low-temperature fusing property of the toner, there is preferably used the method in which a plurality of the polyester resins (a), the alkali aqueous solution and the aforementioned optional components, preferably the colorant, are melted and mixed with each other to obtain the resin mixture.

Upon mixing these components, a surfactant is preferably added thereto from the viewpoint of enhancing an emulsification stability of the resins.

Preferred examples of the alkali contained in the alkali aqueous solution include hydroxides of alkali metals such as potassium hydroxide and sodium hydroxide, and ammonia. From the viewpoint of enhancing a dispersibility of the resins, among these alkalis, more preferred are potassium hydroxide and sodium hydroxide. The concentration of the alkali in the alkali aqueous solution is preferably from 1 to 30% by weight, more preferably from 1 to 25% by weight and still more preferably from 1.5 to 20% by weight.

Examples of the surfactant include a nonionic surfactant, an anionic surfactant and a cationic surfactant. Among these surfactants, the surfactant comprises preferably a nonionic surfactant. The surfactant comprises more preferably combination of the nonionic surfactant with the anionic surfactant or the cationic surfactant. From the viewpoint of enhancing an emulsification stability of the resins, the surfactant comprises still more preferably the nonionic surfactant and the anionic surfactant.

When using the nonionic surfactant in combination with the anionic surfactant, the weight ratio of the nonionic surfactant to the anionic surfactant (nonionic surfactant/anionic surfactant) is preferably from 0.3 to 10 and more preferably from 0.5 to 5 from the viewpoint of enhancing an emulsification stability of the resins.

Examples of the nonionic surfactant include polyoxyethylene alkyl ethers, polyoxyethylene alkyl aryl ethers, polyoxyethylene fatty acid esters and oxyethylene/oxypropylene block copolymers. Among these nonionic surfactants, polyoxyethylene alkyl ethers are preferred from the viewpoint of enhancing an emulsification stability of the resins.

Specific examples of the polyoxyethylene alkyl ethers include polyoxyethylene oleyl ether and polyoxyethylene lauryl ether.

Specific examples of the polyoxyethylene alkyl aryl ethers include polyoxyethylene nonyl phenyl ether.

Specific examples of the polyoxyethylene fatty acid esters include polyethylene glycol monolaurate, polyethylene glycol monostearate and polyethylene glycol monooleate.

Examples of the anionic surfactant include dodecylbenzenesulfonic acid salts, dodecylsulfuric acid salts and alkylethersulfuric acid salts. Among these anionic surfactants, preferred are dodecylbenzenesulfonic acid salts and alkylethersulfuric acid salts from the viewpoint of enhancing an emulsification stability of the resins.

Preferred examples of the dodecylbenzenesulfonic acid salts include alkali metal salts of dodecylbenzenesulfonic acid, and sodium dodecylbenzenesulfonate is more preferred. Preferred examples of the dodecylsulfuric acid salts include alkali metal salts of dodecylsulfuric acid, and sodium dodecylsulfate is more preferred. Preferred examples of the alkylethersulfuric acid salts include alkali metal salts of alkylethersulfuric acids, and more preferred are sodium alkylethersulfates.

Specific examples of the cationic surfactant include alkylbenzenedimethyl ammonium chlorides, alkyltrimethyl ammonium chlorides and dialkyl ammonium chlorides, for example, distearyl ammonium chloride.

The content of the surfactants in the resin mixture is preferably 20 parts by weight or smaller, more preferably 15 parts by weight or smaller, still more preferably from 0.1 to 10 parts by weight and further still more preferably from 0.5 to 10 parts by weight on the basis of 100 parts by weight of the resins constituting the resin particles (A).

As the method of producing the resin mixture, there is preferably used the method in which the resin component containing the polyester resin (a), the alkali aqueous solution and the aforementioned optional components, preferably together with the surfactants, are charged into a vessel, and while stirring the contents of the vessel using a stirrer, the resins are melted and mixed with the other components to prepare a uniform mixture.

The temperature used upon melting and mixing the resins is preferably not lower than a glass transition point of the polyester resin (a) from the viewpoint of obtaining uniform resin particles.

Next, an aqueous medium is added to the above resin mixture to subject the mixture to phase inversion, thereby obtaining a dispersion containing the resin particles (A).

The aqueous medium used herein preferably contains water as a main component. From the viewpoint of enhancing a emulsification stability of the resins, the content of water in the aqueous medium is preferably 80% by weight or more, more preferably 90% by weight or more, still more preferably 95% by weight or more, and especially preferably substantially 100% by weight. As the water, deionized water or distilled water is preferably used.

Examples of components other than water which may be contained in the aqueous medium include water-soluble organic solvents such as alkyl alcohols having 1 to 5 carbon atoms; acetone and dialkyl ($C_1$ to $C_3$) ketones such as methyl ethyl ketone; and cyclic ethers such as tetrahydrofuran. Among these organic solvents, from the viewpoint of preventing inclusion thereof in the toner, preferred are alkyl alcohols having 1 to 5 carbon atoms which are incapable of dissolving the polyester therein, and more preferred are methanol, ethanol, isopropanol and butanol.

The temperature used upon adding the aqueous medium is preferably not lower than a glass transition point of the polyester resin (a).

From the viewpoint of reducing a particle size of the resin particles, the velocity of addition of the aqueous medium until terminating the phase inversion is preferably from 0.1 to 50 parts by weight/min, more preferably from 0.1 to 30 parts by weight/min, still more preferably from 0.5 to 10 parts by weight/min and further still more preferably from 0.5 to 5 parts by weight/min on the basis of 100 parts by weight of the resins constituting the resin particles (A). However, the velocity of addition of the aqueous medium after terminating the phase inversion is not particularly limited.

The amount of the aqueous medium added to the resin mixture is preferably from 100 to 2,000 parts by weight, more preferably from 150 to 1,500 parts by weight and still more preferably from 150 to 500 parts by weight on the basis of 100 parts by weight of the resins constituting the resin particles (A) from the viewpoint of obtaining uniform aggregated particles in the subsequent aggregating step. The solid content of the resulting dispersion of the resin particles is preferably from 7 to 50% by weight, more preferably from 10 to 40% by weight, still more preferably from 20 to 40% by weight and further still more preferably from 25 to 35% by weight from the viewpoint of enhancing a stability of the obtained dispersion of the resin particles. Meanwhile, the solid content means the value based on a total amount of non-volatile components including the resins, the surfactant and the like.

The volume-median particle size ($D_{50}$) of the resin particles (A) contained in the thus obtained dispersion of the resin particles (A) is preferably from 0.02 to 2 μm, more preferably from 0.02 to 1.5 μm, still more preferably from 0.05 to 1 μm and further still more preferably from 0.05 to 0.5 μm from the viewpoint of obtaining a toner capable of forming printed images having a high image quality and a high optical density. Meanwhile, the volume-median particle size as used herein means a particle size at which a cumulative volume frequency calculated on the basis of a volume fraction of particles from a smaller particle size side thereof is 50% which may be measured by the method as described in Examples below.

The coefficient of variation of particle size distribution (CV; %) of the resin particles is preferably 40% or less, more preferably 35% or less, still more preferably 30% or less and further still more preferably 28% or less from the viewpoint of obtaining a toner capable of forming printed images having a high image quality. Meanwhile, the CV means the value represented by the following formula, and specifically is determined by the method as described in Examples below.

$$CV(\%)=[\text{Standard Deviation of Particle Size Distribution } (\mu m)/\text{Volume Average Particle Size } (\mu m)]\times 100.$$

(Releasing Agent Particles)

The releasing agent particles are preferably obtained by dispersing a releasing agent in an aqueous medium.

The releasing agent particles preferably contain a surfactant from the viewpoint of a good aggregating property. The content of the surfactant in the releasing agent particles is preferably from 0.01 to 10 parts by weight and more preferably from 0.1 to 5 parts by weight on the basis of 100 parts by weight of the releasing agent from the viewpoints of a good aggregating property of the particles and a good charging property of the resulting toner.

The volume-median particle size ($D_{50}$) of the releasing agent particles is preferably from 0.1 to 1 μm, more preferably from 0.1 to 0.7 μm and still more preferably from 0.1 to 0.5 μm from the viewpoints of enhancing a charging property of the resulting toner and preventing occurrence of hot offset.

The CV of the releasing agent particles is preferably from 15 to 50%, more preferably from 15 to 40% and still more preferably from 15 to 35% from the viewpoints of enhancing a charging property of the resulting toner and readily controlling aggregation of the particles.

<Releasing Agent>

Examples of the releasing agent include low-molecular weight polyolefins such as polyethylene, polypropylene and polybutene; silicones exhibiting a softening point upon heating, such as silicone waxes; fatty acid amides such as oleamide and stearamide; vegetable waxes; animal waxes such as beeswax; mineral and petroleum waxes; and synthetic waxes such as ester waxes.

Specific examples of the vegetable waxes include carnauba wax, rice wax and candelilla wax. Among these vegetable waxes, preferred is carnauba wax.

Specific examples of the mineral and petroleum waxes include montan wax, paraffin wax and Fischer-Tropsch wax. Among these mineral and petroleum waxes, preferred is paraffin wax.

Of the above releasing agents, from the viewpoint of enhancing a durability and a storage stability of the resulting toner, most preferred is carnauba wax. The carnauba wax has an adequate affinity to the resin particles and therefore are hardly exposed to a surface of the resulting toner even when fused. As a result, it is considered that the carnauba wax serves for enhancing a durability and a storage stability of the resulting toner.

These releasing agents may be used alone or in combination of any two or more thereof.

The melting point of the releasing agent is preferably from 65 to 100° C., more preferably from 75 to 95° C., still more preferably from 75 to 90° C. and further still more preferably from 80 to 90° C. from the viewpoint of enhancing a low-temperature fusing property, a storage stability and a durability of the resulting toner.

In the present invention, the melting point of the releasing agent may be determined by the method described in Examples below. When two or more kinds of releasing agents are used in combination, the melting point of the releasing agent as defined in the present invention means a melting point of the releasing agent having a largest weight ratio among the releasing agents contained in the resulting toner. Meanwhile, if all of the releasing agents have the same weight ratios, the lowest melting point among those of the releasing agents is regarded as the melting point of the releasing agent as defined in the present invention.

The amount of the releasing agent used is preferably from 1 to 20 parts by weight and more preferably from 2 to 15 parts by weight on the basis of 100 parts by weight of the resins contained in the toner from the viewpoint of enhancing a releasability and a charging property of the resulting toner.

<Production of Releasing Agent Particles>

The releasing agent particles are preferably obtained in the form of a dispersion of the releasing agent particles which is prepared by dispersing the releasing agent in an aqueous medium.

The dispersion of the releasing agent particles is preferably obtained by dispersing the releasing agent and the aqueous medium in the presence of a surfactant at a temperature not lower than a melting point of the releasing agent using a disperser. Examples of the disperser used include a homogenizer and an ultrasonic disperser.

The aqueous medium and the surfactant used for production of the releasing agent particles are preferably the same as those used for producing the resin particles (A). The aqueous medium used preferably contains water as a main component. From the viewpoint of obtaining stable particles, the content of water in the aqueous medium is preferably 90% by weight or more, more preferably 95% by weight or more, and still more preferably substantially 100% by weight. As the water, deionized water or distilled water is preferably used. The surfactant is preferably an anionic surfactant. Among the anionic surfactants, preferred are those containing a carboxyl group as a hydrophilic group, and more preferred are dipotassium alkenylsuccinates.

(Aggregating Agent)

The aggregating agent used in the present invention is formed of a divalent to pentavalent amine salt. The aggregating agent is mixed with the resin particles and the releasing agent particles in the aqueous medium to thereby obtain a dispersion of aggregated particles efficiently.

The valence of an amine in the amine salt is from 2 to 5. More specifically, the amine in the amine salt used in the present invention is an organic compound containing 2 to 5 amino groups in a molecule thereof. It is required that a compound containing a monovalent cation (valence: 1) such as ammonium sulfate which has been conventionally used as an aggregating agent is used in a large amount and at a high concentration on the basis of the resin particles in order to aggregate the releasing agent particles with the resin particles upon production of the toner. In this case, in order to fully fuse the obtained aggregated particles, the maintaining temperature must be kept high. On the other hand, the aggregating agent used in the present invention which contains 2 to 5 amino groups in a molecule thereof is capable of forming a divalent to pentavalent cation, so that the aggregated particles can be more efficiently produced even when using the aggregating agent in a very small amount and can be fused together even at a low temperature. When the valence of the amine is 6 or more, it may be difficult to control aggregation of the particles, so that the aggregation tends to proceed excessively and the resulting particles tend to be coarse particles.

The valence of the amine in the amine salt is preferably from 2 to 4, more preferably from 2 to 3 and still more preferably 2 from the viewpoint of suppressing formation of the coarse particles.

The divalent to pentavalent amine salt is preferably an amine acid salt as a salt of an amine and an acid. The amine is an organic compound containing 2 to 5 amino groups. Preferred examples of the amine include ethylenediamine, 1,4-diaminobutane, hexamethylenediamine, triethylenetetramine, diethylenetriamine, tetraethylenepentamine, tris(2-aminoethyl)amine and piperazine from the viewpoints of controlling the aggregation in water and enhancing a charging property of the resulting toner. Among these amines, preferred are ethylenediamine, 1,4-diaminobutane, hexamethylenediamine, tetraethylenepentamine and piperazine; more preferred are ethylenediamine, 1,4-diaminobutane, hexamethylenediamine, tetraethylenepentamine and piperazine; still more preferred are ethylenediamine and hexamethylenediamine; and especially preferred is ethylenediamine. Examples of the acid forming the salt include hydrochloric acid and sulfuric acid.

The divalent to pentavalent amine acid salt is preferably a mineral acid salt of a divalent to pentavalent amine and more preferably a hydrochloride and a sulfate of a divalent to pentavalent amine from the viewpoint of forming the aggregated particles having a narrow particle size distribution, and is still more preferably a hydrochloride of a divalent to pentavalent amine from the viewpoint of a high safety upon handling.

Specific examples of the preferred divalent to pentavalent amine acid salt include ethylenediamine dihydrochloride, 1,4-diaminobutane dihydrochloride, hexamethylenediamine dihydrochloride, triethylenetetramine tetrahydrochloride, tetraethylenepentamine pentahydrochloride and piperazine dihydrochloride. Among these amine acid salts, preferred are ethylenediamine dihydrochloride, hexamethylenediamine dihydrochloride, tetraethylenepentamine pentahydrochloride and piperazine dihydrochloride, more preferred are ethylenediamine dihydrochloride and hexamethylenediamine dihydrochloride, and still more preferred is ethylenediamine dihydrochloride.

The divalent to pentavalent amine salt used in the present invention forms substantially a divalent to pentavalent cation in an aqueous solution thereof. For example, ethylenediamine dihydrochloride ($H_2NCH_2CH_2NH_2.2HCl$) is a compound capable of forming a divalent cation represented by the formula:

$$Cl^-H_3N^+CH_2CH_2N^+H_3Cl^-.$$

The molecular weight of the divalent to pentavalent amine salt is preferably from 100 to 1,000, more preferably from 100 to 800, still more preferably from 100 to 400 and especially preferably from 120 to 200 from the viewpoints of well-controlled aggregation of the particles and enhancing a charging property of the resulting toner.

(Resin Particles (B))

The resin particles (B) used in the present invention preferably contain a polyester resin (b) from the viewpoint of enhancing a storage stability and a charging property of the resulting toner.

The glass transition point of the resin particles (B) may be appropriately determined according to glass transition points of resins constituting the resin particles (B) such as the polyester resin (b), kinds and amounts of additives used, etc. From the viewpoint of enhancing a durability, a low-temperature fusing property and a storage stability of the resulting toner, the glass transition point of the resin particles (B) is preferably 55° C. or higher, more preferably from 55 to 75° C., still more preferably from 55 to 70° C. and especially preferably from 55 to 65° C.

<Polyester Resin (b)>

In the present invention, the polyester resin (b) is preferably a non-crystalline polyester, i.e., a polyester having a crystallinity index of more than 1.4 or less than 0.6 as described above. The crystallinity index of the polyester resin (b) is preferably less than 0.6 or more than 1.4 but not more than 4, more preferably less than 0.6 or not less than 1.5 but not more than 4, still more preferably less than 0.6 or not less than 1.5 but not more than 3, and especially preferably less than 0.6 or not less than 1.5 but not more than 2 from the viewpoint of enhancing a low-temperature fusing property of the resulting toner. The crystallinity index of the polyester resin (b) may be appropriately determined according to the kinds and proportions of raw monomers used, production conditions such as, reaction temperature, reaction time and cooling rate, etc.

The polyester resin (b) is preferably a non-crystalline polyester containing an acid group at a terminal end of a molecule thereof from the viewpoints of facilitating emulsification of a dispersion of the resin particles and enhancing a dispersion stability thereof. Examples of the acid group in the polyester resin (b) include a carboxyl group, a sulfonic group, a phosphonic group and a sulfinic group. Among these acid groups, preferred is a carboxyl group from the viewpoint of facilitating emulsification of the polyester.

The polyester resin (b) may be produced by subjecting an acid component and an alcohol component to polycondensation reaction according to the same method as used for production of the above polyester resin (a).

Examples of the acid component include dicarboxylic acids, trivalent or higher-valent polycarboxylic acids, and anhydrides and alkyl ($C_1$ to $C_3$) esters of these acids. Among these acids, preferred are dicarboxylic acids.

Specific examples of the dicarboxylic acids include phthalic acid, isophthalic acid, terephthalic acid, sebacic acid, fumaric acid, maleic acid, adipic acid, azelaic acid, succinic acid, cyclohexanedicarboxylic acid, and succinic acids substituted with an alkyl group having 1 to 20 carbon atoms or an alkenyl group having 2 to 20 carbon atoms. Among these dicarboxylic acids, preferred is terephthalic acid from the viewpoint of enhancing a charging property of the resulting toner.

Specific examples of the succinic acids substituted with an alkyl group having 1 to 20 carbon atoms or an alkenyl group having 2 to 20 carbon atoms include dodecylsuccinic acid, dodecenylsuccinic acid and octenylsuccinic acid.

Specific examples of the trivalent or higher-valent polycarboxylic acids include trimellitic acid, 2,5,7-naphthalene-tricarboxylic acid and pyromellitic acid. Among these polycarboxylic acids, preferred are trimellitic acid and trimellitic anhydride from the viewpoint of enhancing an anti-offset property of the resulting toner.

These acid components may be used alone or in combination of any two or more thereof.

The polyester resin (b) preferably contains at least one non-crystalline polyester obtained using an acid component containing a trivalent or higher-valent polycarboxylic acid or an anhydride or an alkyl ester thereof, preferably trimellitic acid or trimellitic anhydride, from the viewpoint of enhancing an anti-offset property of the resulting toner.

As the alcohol component, there may be use the same alcohol components as used for production of the polyester resin (a). Among these alcohol components, from the viewpoints of obtaining the non-crystalline polyester and enhancing a charging property of the resulting toner, preferred are aromatic diols, and more preferred are alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane.

These alcohol components may be used alone or in combination of any two or more thereof.

The glass transition point of the polyester resin (b) is preferably from 55 to 75° C., more preferably from 55 to 70° C. and still more preferably from 58 to 68° C. from the viewpoint of enhancing a durability, a low-temperature fusing property and a storage stability of the resulting toner.

Form the viewpoint of enhancing a durability, a low-temperature fusing property and a storage stability of the resulting toner, the softening point of the polyester resin (b) is preferably from 70 to 165° C., more preferably from 70 to 140° C., still more preferably from 90 to 140° C. and especially preferably from 100 to 130° C.

Meanwhile, in the case where the polyester resin (b) is in the form of a mixture of two or more kinds of polyester resins, the glass transition point and softening point of the polyester resin (b) are respectively determined from the values of a glass transition point and a softening point of the mixture of two or more kind of polyester resins as measured according to the method described in Examples below.

The number-average molecular weight of the polyester resin (b) is preferably from 1,000 to 50,000, more preferably from 1,000 to 10,000 and still more preferably from 2,000 to 8,000 from the viewpoint of enhancing a durability, a low-temperature fusing property and a storage stability of the resulting toner.

The acid value of the polyester resin (b) is preferably from 6 to 35 mgKOH/g, more preferably from 10 to 35 mgKOH/g and still more preferably from 15 to 35 mgKOH/g from the viewpoint of facilitating emulsification of the resins in an aqueous medium.

The polyester resin (b) preferably contain two or more kinds of polyesters which are different in softening point from each other from the viewpoint of enhancing a low-temperature fusing property, an anti-offset property and a durability of the resulting toner. Among the two kinds of polyesters which are different in softening point from each other, the softening point of one polyester (b-1) is preferably not lower than 70° C. and lower than 115° C., whereas the softening point of the other polyester (b-2) is preferably not lower than 115° C. and not higher than 165° C. The weight ratio of the polyester (b-1) to the polyester (b-2) ((b-1)/(b-2)) is preferably from 10/90 to 90/10 and more preferably from 50/50 to 90/10.

From the viewpoint of enhancing a storage stability and a charging property of the resulting toner, the content of the polyester resin (b) in the resin particles (B) is preferably 70% by weight or more, more preferably 80% by weight or more, still more preferably 90% by weight or more and especially preferably substantially 100% by weight.

The resin particles (B) may contain, in addition to the polyester resin (b), known resins ordinarily used in toners. Examples of the known resins include styrene-acryl copolymers, epoxy resins, polycarbonates and polyurethanes.

The resin particles (B) may be obtained by the same method as used for production of the above resin particles (A). In the method of producing the resin particles (B), the same alkali aqueous solution, surfactants and aqueous medium as those used for production of the resin particles (A) may also be suitably used.

Meanwhile, in the present invention, the polyester resins (a) and (b) may be respectively used in the form of a modified product thereof unless the aimed effects of the present invention are adversely influenced. As the method of modifying the respective polyesters, there may be mentioned the method of grafting or blocking the polyester with phenol, urethane, epoxy, etc., by the methods described, for example, in JP 11-133668A, JP 10-239903A and JP 8-20636A, and the method of forming composite resins containing two or more kinds of resin units including a polyester unit, etc.

In the following, the respective steps of the process for producing a toner for development of electrostatic latent images according to the present invention are explained.

[Step (1)]

In the step (1), the resin particles (A), the releasing agent particles and the aggregating agent formed of the divalent to pentavalent amine salt are mixed and aggregated together in an aqueous medium to obtain aggregated particles (1).

The order of mixing of the respective components is not particularly limited, and these components may be added either sequentially in any order or simultaneously at the same time. From the viewpoint of efficiently obtaining a dispersion of the aggregated particles, it is preferred that the resin particles (A) and the releasing agent particles are first mixed with each other, and then the resulting mixture is mixed with the aggregating agent. In the following, the method in which the resin particles (A) and the releasing agent particles are first mixed with each other, and then the resulting mixture is mixed with the aggregating agent is described.

In the step (1), first, the resin particles (A) and the releasing agent particles are mixed with each other in an aqueous medium to obtain a mixed dispersion.

The temperature of the mixed dispersion upon the mixing is preferably from 0 to 40° C. from the viewpoint of well-controlled aggregation.

The content of the resin particles (A) in the mixed dispersion is preferably from 10 to 40 parts by weight, more preferably from 12 to 35 parts by weight and still more preferably from 12 to 20 parts by weight on the basis of 100 parts by weight of a dispersion of the aggregated particles (1), whereas the content of the aqueous medium in the mixed dispersion is preferably from 60 to 90 parts by weight and more preferably from 70 to 88 parts by weight on the basis of 100 parts by weight of a dispersion of the aggregated particles (1).

Also, when the resin particles (A) contains a colorant, the content of the colorant in the resin particles (A) is preferably from 1 to 20 parts by weight and more preferably from 3 to 15 parts by weight on the basis of 100 parts by weight of the resins constituting the resin particles (A) from the viewpoint of enhancing an optical density of printed images obtained using the toner.

The content of the releasing agent particles in the mixed dispersion is preferably from 1 to 20 parts by weight and more preferably from 2 to 15 parts by weight on the basis of 100 parts by weight of a total amount of the resins and the colorant from the viewpoint of enhancing a releasing property and a charging property of the resulting toner.

In the step (1), colorant-containing particles or resin particles other than the resin particles (A) may be added and mixed. The resin particles other than the resin particles (A) are preferably non-crystalline polyester-containing resin particles and more preferably resin particles having the same composition as that of the above-mentioned resin particles (B) from the viewpoint of enhancing a storage stability of the resulting toner.

Next, the aggregating agent formed of the divalent to pentavalent amine salt is mixed with the above mixed dispersion in an aqueous medium to aggregate the particles in the mixed dispersion, thereby obtaining a dispersion of the aggregated particles (1).

The aggregating agent is preferably used in an amount of 10 parts by weight or less, more preferably 4 parts by weight or less, still more preferably 3 parts by weight or less and especially preferably 2.0 parts by weight or less on the basis of 100 parts by weight of the resins constituting the resin particles (A) from the viewpoint of enhancing a storage stability and a durability of the resulting toner. Also, from the viewpoint of a good aggregating property of the resin particles, the aggregating agent is preferably used in an amount of 0.1 part by weight or more, more preferably 0.3 part by weight or more, still more preferably 0.5 part by weight or more and especially preferably 1.0 part by weight or more on the basis of 100 parts by weight of the resins constituting the resin particles (A). From these viewpoints, the aggregating agent is preferably used in an amount of from 0.1 to 10 parts by weight, more preferably from 0.3 to 4 parts by weight, still more preferably from 0.5 to 3 parts by weight and especially preferably from 1.0 to 2.0 parts by weight on the basis of 100 parts by weight of the resins constituting the resin particles (A).

As the aggregating method, there is preferably used the method in which an aqueous solution of the aggregating agent is added dropwise into a vessel filled with the mixed dispersion. In this case, the aggregating agent may be added at one time, or intermittently or continuously. During and after adding the aggregating agent, the obtained dispersion is preferably fully stirred. From the viewpoint of well-controlled aggregation and shortened production time of the toner, the dropping time of the aggregating agent is preferably from 1 to 120 min. Also, the dropping temperature of the aggregating agent is preferably from 0 to 40° C. from the viewpoint of well-controlled aggregation. Further, from the viewpoint of promoting aggregation of the particles, after completion of adding the aggregating agent dropwise, the resulting dispersion is preferably maintained at a temperature of from 40 to 60° C.

From the viewpoint of preventing reduction in particle size of the toner and obtaining printed images having a high image quality, the volume median particle size ($D_{50}$) of the obtained aggregated particles (1) is preferably from 1 to 10 μm, more preferably from 2 to 9 μm and still more preferably from 3 to 6 μm, and the CV of the aggregated particles (1) is preferably 30% or less, more preferably 28% or less and still more preferably 25% or less.

[Step (2)]

In the step (2), the resin particles (B) containing the polyester resin (b) are added and mixed with the aggregated particles (1) obtained in the step (1) to obtain aggregated particles (2).

Although the step (2) is optional, it is preferred that the step (2) is carried out to attain uniform surface conditions of the resulting toner and ensure incorporation of the releasing agent into the toner, and thereby enhance a low-temperature fusing property and a charging property of the resulting toner.

In the step (2), it is preferred that a dispersion of the resin particles (B) containing the polyester resin (b) is first prepared and then added to a dispersion of the aggregated particles (1) obtained in the step (1) to allow the resin particles (B) to adhere to the aggregated particles (1), thereby obtaining the aggregated particles (2).

The aggregated particles (2) preferably have such a structure that the resin particles (B) are allowed to adhere to a surface of the respective aggregated particles (1).

From the viewpoint of allowing the resin particles (B) to more uniformly adhere onto the aggregated particles (1), before adding the dispersion of the resin particles (B) to the dispersion of the aggregated particles (1), the dispersion of the aggregated particles (1) is preferably diluted by adding an aqueous medium thereto.

Upon adding the dispersion of the resin particles (B), the above aggregating agent may be further added in order to allow the resin particles (B) to adhere to the aggregated particles (1) efficiently.

As the method of adding the dispersion of the resin particles (B), there may be mentioned the method in which the dispersion of the resin particles (B) is added to the dispersion of the aggregated particles (1) while gradually raising a temperature of the dispersion of the aggregated particles (1), the method in which the aggregating agent and the dispersion of the resin particles (B) are added simultaneously to the dispersion of the aggregated particles (1), the method in which the aggregating agent and the dispersion of the resin particles (B) are added alternately to the dispersion of the aggregated particles (1), etc. According to these methods, it is possible to prevent deterioration in aggregating property of the aggregated particles (1) and the resin particles (B). From the viewpoints of a high productivity of the toner and facilitated production thereof, among these methods, there is preferably used the method in which the dispersion of the resin particles (B) is added to the dispersion of the aggregated particles (1) while gradually raising a temperature of the dispersion of the aggregated particles (1).

In the step (2), the reaction system during and/or after addition of the resin particles (B) is preferably maintained at a temperature lower than a melting point of the releasing agent and not lower than a temperature lower by 10° C. than a glass transition point of the polyester resin (b). It is not necessarily required that the reaction system is maintained in the above temperature range upon addition of the resin particles (B). However, in such a case, it is preferred that the reaction system is maintained in the above temperature range after completion of addition of the resin particles (B).

When the temperature upon addition of the resin particles (B) is controlled to a temperature lower than a melting point of the releasing agent, the resulting toner can exhibit a good low-temperature fusing property and a good storage stability as well as a good charging property. The reason therefor is considered as follows although it is not clearly determined. That is, it is considered that since adhesion between the aggregated particles (2) hardly occurs, formation of coarse particles can be prevented, and crystallinity of the releasing agent can be maintained.

In addition, in the case where it is intended to promote adhesion of the resin particles (B), the reaction system upon addition of the resin particles (B) may be maintained at a temperature not lower than a temperature lower by 10° C. than a glass transition point of the polyester resin (b).

From the viewpoints of enhancing a low-temperature fusing property and a storage stability as well as a charging property of the resulting toner, and suppressing occurrence of scattering of the toner (toner cloud) within a printing device such as a printer, the amount of the resin particles (B) added is controlled such that the weight ratio of the resin particles (B) to the resin particles (A) [resin particles (B)/resin particles (A)] is preferably from 0.3 to 1.5, more preferably from 0.3 to 1.0 and still more preferably from 0.3 to 0.75.

The dispersion of the resin particles (B) may be added continuously over a predetermined period of time, or may be added at one time or intermittently in plural divided parts. From the viewpoint of facilitating selective adhesion of the resin particles (B) onto the aggregated particles (1), the dispersion of the resin particles (B) is preferably added continuously over a predetermined period of time or intermittently in plural divided parts. Among these methods, from the viewpoints of promotion of selective adhesion of the resin particles (B) onto the aggregated particles (1) and efficient production of the toner, the dispersion of the resin particles (B) is preferably added continuously over a predetermined period of time. The time period of continuously adding the dispersion of the resin particles (B) to the dispersion of the aggregated particles (1) is preferably from 1 to 10 hours and more preferably from 3 to 8 hours from the viewpoints of obtaining particles having a uniform core/shell structure over the whole particles and shortening a production time of the toner in the subsequent step.

After adding a whole amount of the resin particles (B) and allowing growth of the particles until they have an adequate particle size suitable as a toner, the aggregation step is terminated.

The particle size at which the aggregation step is terminated is controlled such that the volume median particle size ($D_{50}$) of the resulting aggregated particles is preferably from 1 to 10 μm, more preferably from 2 to 10 μm, still more preferably from 3 to 7 μm and especially preferably from 4 to 6 μm.

As the method of terminating the aggregation step, there are preferably used the method of cooling the dispersion, the method of adding an aggregation stopping agent, or the like. From the viewpoint of surely preventing unnecessary aggregation of the particles, among these methods, preferred is the method of adding the aggregation stopping agent to terminate the aggregation step.

As the aggregation stopping agent, a surfactant is preferably used. The aggregation stopping agent is more preferably an anionic surfactant. Examples of the anionic surfactant include alkylether sulfuric acid salts, alkyl sulfuric acid salts and straight-chain alkylbenzenesulfonic acid salts. These aggregation stopping agents may be used alone or in combination of any two or more thereof.

The aggregation stopping agent is preferably added in an amount of from 0.1 to 15 parts by weight, more preferably from 0.1 to 10 parts by weight and still more preferably from 0.1 to 8 parts by weight on the basis of 100 parts by weight of a total amount of the resins contained in the reaction system from the viewpoints of terminating the aggregation step and reducing an amount of the aggregation stopping agent remaining in the resulting toner. The aggregation stopping agent may be used in any configuration, and is preferably used in the form of an aqueous solution from the viewpoint of a high productivity.

[Step (3)]

In the step (3), the aggregated particles (1) or the aggregated particles (2) are maintained at a temperature not lower than a glass transition point of the resin particles (A) to thereby obtain fused particles.

In the present invention, the method of fusing the aggregated particles (1) or the aggregated particles (2) is not particularly limited. However, the step (3) is preferably used in the process of the present invention to fuse the aggregated particles (1) or the aggregated particles (2).

In the step (3), the dispersion containing the aggregated particles (1) or the aggregated particles (2) is maintained at a temperature at which the particles constituting the aggregated particles (1) or the aggregated particles (2), i.e., the resin particles (A) and/or (B) as well as the releasing agent particles and the like, can be fused together therebetween, to thereby obtain fused particles. In particular, when the aggregated particles (2) are fused, it is possible to obtain fused particles having a core/shell structure.

In the following, the step of fusing the aggregated particles (2) is explained.

The maintaining temperature used for fusing the aggregated particles (2) is preferably a temperature not lower than a glass transition point of the above polyester resin (a) contained in the resin particles (A). From the viewpoints of enhancing a storage stability and a charging property of the resulting toner and suppressing occurrence of toner cloud, the maintaining temperature upon fusing the aggregated particles (2) is more preferably lower than a melting point of the releasing agent and not lower than a temperature lower by 10° C. than a glass transition point of the polyester resin (b).

Meanwhile, when the temperature of the reaction system is already controlled to the above temperature range upon adding the resin particles (B) thereto, it is not necessary to control the maintaining temperature again to the above temperature range after adding the resin particles (B). However, in the case where it is required to control a particle size and a particle shape, the resin particles (B) are added at a temperature lower than a temperature lower by 10° C. than a glass transition point of the polyester resin (b), and after completion of the addition, the reaction system is preferably controlled and maintained at a temperature not lower than the temperature lower by 10° C. than the glass transition point.

The maintaining temperature after completion of addition of the resin particles (B) is controlled to a temperature lower than a melting point of the releasing agent, preferably a temperature lower than a temperature lower by 5° C. than the melting point of the releasing agent, and more preferably a temperature lower than a temperature lower by 10° C. than the melting point of the releasing agent, from the viewpoint of enhancing a charging property of the resulting toner.

In addition, the maintaining temperature after completion of addition of the resin particles (B) is controlled to a temperature not lower than a temperature lower by 10° C. than a glass transition point of the polyester resin (b), preferably a temperature not lower than a temperature lower by 5° C. than the glass transition point of the polyester resin (b), and more preferably a temperature not lower than a temperature lower by 2° C. than the glass transition point of the polyester resin (b) from the viewpoints of improving a fusibility of the aggregated particles and enhancing a storage stability, a charging property and a productivity of the toner.

By satisfying the above conditions, it becomes possible to maintain a crystalline condition of the releasing agent which is capable of exhibiting a good fusing property of the toner even at a low temperature and suppress exposure of the releasing agent to a surface of the toner which tends to cause deterioration in storage stability and charging property of the toner, so that the particles constituting a shell portion of the toner can be uniformly fused. As a result, it is considered that the obtained toner is excellent in all of low-temperature fusing property, charging property and storage stability.

Further, from the viewpoint of improving a fusibility of the aggregated particles, enhancing a storage stability and a charging property of the resulting toner, and increasing a productivity of the toner, the reaction system of the step (3) is preferably maintained at a temperature not lower than a temperature lower by 5° C. than a glass transition point of the resin particles (B), and more preferably a temperature not lower than a temperature lower by 2° C. than the glass transition point of the resin particles (B).

From the above viewpoints, the maintaining temperature of the reaction system in the step (3) is preferably from 58 to 69° C., more preferably from 59 to 67° C. and still more preferably from 60 to 64° C.

The maintaining time in the step (3) is preferably from 1 to 24 hours, more preferably from 1 to 12 hours and still more preferably from 2 to 6 hours from the viewpoints of a good fusibility of the aggregated particles, a good storage stability and a good charging property of the resulting toner and a high productivity of the toner.

In the step (3), the progress of fusion of the aggregated particles is preferably confirmed by monitoring a circularity of the fused core/shell particles as produced. The circularity of the core/shell particles is monitored by the method described in Examples below. When the circularity reaches 0.950 or more, the reaction system is cooled to terminate fusion of the particles. The circularity of the fused core/shell particles contained in a dispersion of the finally obtained fused core/shell particles is from 0.950 to 0.980, preferably from 0.955 to 0.970 and still more preferably from 0.955 to 0.965 from the viewpoint of enhancing a storage stability of the resulting toner.

From the viewpoint of obtaining printed images having a high image quality by using the toner, the volume median particle size ($D_{50}$) of the core/shell particles contained in the dispersion of the thus obtained core/shell particles is preferably from 2 to 10 μm, more preferably from 2 to 8 μm, still more preferably from 2 to 7 μm, further still more preferably from 3 to 8 μm and especially preferably from 4 to 6 μm.

[Additional Treatment Step]

In the present invention, subsequent to completion of the step (3), the obtained dispersion may be subjected to an additional treatment step. In the additional treatment step, the core/shell particles are preferably isolated from the dispersion to obtain toner particles.

The core/shell particles obtained in the step (3) are present in the aqueous medium. Therefore, the dispersion is preferably first subjected to solid-liquid separation. The solid-liquid separation procedure is preferably conducted by a suction filtration method, etc.

The particles obtained by the solid-liquid separation are then preferably subjected to rinsing treatment. For the purpose of ensuring sufficient charging property and reliability of the resulting toner, the particles are preferably rinsed with an acid in order to remove metal ions from the surface of the toner. Further, the nonionic surfactant added is also preferably removed by the rinsing treatment. Therefore, the resulting particles are preferably rinsed with an aqueous solution at a temperature not higher than a cloud point of the nonionic surfactant. The rinsing treatment is preferably carried out plural times.

Next, the obtained particles are preferably dried. As the drying method, there are preferably used a vibration-type fluidization drying method, a spray-drying method, a freeze-drying method and a flash jet method, etc. The content of water in the particles obtained after drying is preferably adjusted to 1.5% by weight or less and more preferably 1.0% by weight or less from the viewpoints of suppressing occurrence of toner cloud and enhancing a charging property of the resulting toner.

<Toner for Development of Electrostatic Latent Images>

(Toner)

The toner particles obtained by the drying, etc., may be directly used as a toner. However, the toner particles are preferably subjected to the below-mentioned surface treatment, and the thus surface-treated toner particles are preferably used as the toner for development of electrostatic latent images according to the present invention.

The softening point of the resulting toner is preferably from 60 to 140° C., more preferably from 60 to 130° C. and still more preferably from 60 to 120° C. from the viewpoint of a good low-temperature fusing property of the toner. The glass transition point of the toner is preferably from 30 to 80° C. and more preferably from 40 to 70° C. from the viewpoint of enhancing a low-temperature fusing property, a durability and a storage stability of the resulting toner.

The circularity of the toner is preferably from 0.950 to 0.980, more preferably from 0.955 to 0.970, and still more preferably from 0.955 to 0.965 from the viewpoint of enhancing a storage stability, a charging property and a cleaning property of the resulting toner. The circularity of the toner particles may be measured by the below-mentioned method. Meanwhile, the circularity of the toner particles as used in the present invention means the value calculated from a ratio of a peripheral length of a circle having the same area as a projected area of a particle to a peripheral length of a projected image of the particle. As the shape of the particles is closer to a sphere, the circularity of the particles becomes closer to 1.

The toner obtained according to the process of the present invention has a core/shell structure whose shell portion preferably contains the polyester resin (b) in an amount of from 50 to 100% by weight, more preferably from 70 to 100% by weight and still more preferably from 90 to 100% by weight.

The volume median particle size ($D_{50}$) of the toner is preferably from 1 to 10 μm, more preferably from 2 to 8 μm, still more preferably from 3 to 7 μm and further still more preferably from 4 to 6 μm from the viewpoints of obtaining printed images having a high image quality and further improving a productivity of the toner.

The CV of the toner is preferably 30% or less, more preferably 27% or less, still more preferably 25% or less and further still more preferably 22% or less from the viewpoints of obtaining printed images having a high image quality and further improving a productivity of the toner.

(External Additives)

The thus obtained toner particles may be directly used as the toner for development of electrostatic latent images according to the present invention. However, it is preferred that an external additive such as a fluidizing agent is added and adhered onto a surface of the respective toner particles, and the resulting toner particles are used as the toner for development of electrostatic latent images according to the present invention.

Examples of the external additive include optional fine particles, for example, inorganic fine particles such as hydrophobic silica fine particles, titanium oxide fine particles, alumina fine particles, cerium oxide fine particles and carbon blacks; and polymer fine particles such as fine particles of polycarbonates, polymethyl methacrylate, silicone resins, etc. Among these fine particles, preferred are hydrophobic silica fine particles.

When subjecting the toner particles to surface treatment with the external additive, the amount of the external additive added to the toner is preferably from 1 to 5 parts by weight, more preferably from 1 to 4.5 parts by weight and still more preferably from 1 to 4.3 parts by weight on the basis of 100 parts by weight of the toner particles before being treated with the external additive.

The toner for development of electrostatic latent images obtained according to the present invention can be used as one-component system developer, or can be mixed with a carrier to form a two-component system developer.

EXAMPLES

Various properties of polyesters, resin particles, toners, etc., were measured and evaluated by the following methods.

[Acid Value of Polyester]

The acid value was measured by the method according to JIS K 0070. However, the solvent for the measurement was replaced with a mixed solvent containing acetone and toluene at a volume ratio of 1:1.

[Softening Point of Toner, and Softening Point, Endothermic Maximum Peak Temperature and Glass Transition Point of Polyester]

(1) Softening Point

Using a flow tester "CFT-500D" (tradename) available from Shimadzu Corporation, 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half amount of the sample was flowed out when plotting a downward movement of the plunger of the flow tester relative to the temperature.

(2) Endothermic Maximum Peak Temperature and Glass Transition Point

Using a differential scanning calorimeter "Pyris 6 DSC" (tradename) commercially available from PerkinElmer Co., Ltd., the sample was heated to 200° C. and then cooled from 200° C. to 0° C. at a temperature drop rate of 50° C./min, and thereafter heated again at a temperature rise rate of 10° C./min to prepare an endothermic characteristic curve thereof. Among the endothermic peaks observed in the characteristic curve, the temperature of the peak having a largest peak area was regarded as an endothermic maximum peak temperature. Also, in the case of a crystalline polyester, the peak temperature was regarded as a melting point thereof. In the case of a non-crystalline polyester, if any endothermic peak was observed in a characteristic curve thereof, the endothermic peak temperature observed was regarded as a glass transition point thereof. Whereas, when a shift of the characteristic curve was observed without any peaks, the temperature at which a tangential line having a maximum inclination of the curve in the portion of the curve shift was intersected with an extension of the baseline on the high-temperature side of the curve shift was read as the glass transition point.

[Glass Transition Point of Resin Particles]

First, a dispersion of the resin particles was subjected to freeze-drying to remove a solvent therefrom, thereby obtaining solids.

The freeze-drying of the dispersion of the resin particles was conducted as follows. That is, using a freeze dryer "FDU-2100" and "DRC-1000" (tradenames) both available from Tokyo Rikakikai Co., Ltd., 30 g of the dispersion of the resin particles were vacuum-dried at −25° C. for 1 hour, at −10° C. for 10 hours and then at 25° C. for 4 hours until the water content therein reached 1% by weight or less. The water content was measured as follows. That is, using an infrared moisture meter "FD-230" (tradename) available from Kett Electric Laboratory, 5 g of the sample obtained after being dried were subjected to measurement of a water content thereof at a drying temperature of 150° C. under a measuring mode 96 (monitoring time: 2.5 min/variation range: 0.05%).

The glass transition point of solids obtained after removing the solvent from the dispersion was measured as a glass transition point of the resin particles by the same method as used above for measuring the glass transition point of the polyester.

[Number-Average Molecular Weight of Polyester]

The number-average molecular weight was calculated from the molecular weight distribution measured by gel permeation chromatography according to the following method.

(1) Preparation of Sample Solution

The polyester was dissolved in chloroform to prepare a solution thereof having a concentration of 0.5 g/100 mL. The resultant solution was then filtered through a fluororesin filter having a pore size of 2 μm "FP-200" (tradename) commercially available from Sumitomo Electric Industries, Ltd. to remove insoluble components therefrom, thereby preparing a sample solution.

(2) Measurement of Molecular Weight Distribution

Chloroform as an eluent was allowed to flow through a column at a flow rate of 1 mL/min, and the column was stabilized in a thermostat at 40° C. One hundred microliters of the sample solution were injected to the column to measure a molecular weight distribution of the sample. The molecular weight of the sample was calculated on the basis of a calibration curve previously prepared. The calibration curve of the molecular weight was prepared by using several kinds of monodisperse polystyrenes (those monodisperse polystyrenes having weight-average molecular weights of $2.63\times10^3$, $2.06\times10^4$ and $1.02\times10^5$ available from Tosoh Corporation; and those monodisperse polystyrenes having weight-average molecular weights of $2.10\times10^3$, $7.00\times10^3$ and $5.04\times10^4$ available from GL Science Inc.) as reference standard samples.

Analyzer: "CO-8010" (tradename): commercially available from Tosoh Corporation.

Column: "$GMH_{XL}$"+"$G3000H_{XL}$" (tradenames): both commercially available from Tosoh Corporation.

[Volume Median Particle Size ($D_{50}$) and Particle Size Distribution of Resin Particles and Releasing Agent Particles]

(1) Measuring Apparatus: Laser diffraction particle size analyzer "LA-920" (tradename) commercially available from HORIBA, Ltd.

(2) Measuring Conditions: Using a cell for the measurement which was filled with distilled water, a volume median particle size ($D_{50}$) of the particles was measured at a temperature at which an absorbance thereof was fallen within an adequate range. Also, the CV as a particle size distribution of the particles was calculated from the volume-average particle size of the particles as measured by the above particle size analyzer and a standard deviation thereof according to the following formula:

$CV(\%)$=(Standard Deviation of Particle Size Distribution/Volume Average Particle Size)×100.

[Concentration of Solid Components in Dispersion of Resin Particles]

Using an infrared moisture meter "FD-230" (tradename) available from Kett Electric Laboratory, 5 g of a dispersion of colored particles or resin particles were subjected to measurement of a water content (%) thereof at a drying temperature of 150° C. under a measuring mode 96 (monitoring time: 2.5 min/variation range: 0.05%). The concentration of solid components in the dispersion was calculated according to the following formula:

Solid Concentration (wt %)=100−M wherein M is a water content (%) which is represented by the formula: $[(W-W_0)/W]\times 100$ wherein W is a weight of the sample before the measurement (initial weight of the sample); and $W_0$ is a weight of the sample after the measurement (absolute dry weight).

[Volume Median Particle Size ($D_{50}$) and Particle Size Distribution of Toner (Particles) and Aggregated Particles]

The volume median particle size of the toner (particles) was measured as follows.

Measuring Apparatus: "Coulter Multisizer III" (tradename) commercially available from Beckman Coulter Inc.

Aperture Diameter: 50 μm

Analyzing Software: "Multisizer III Ver. 3.51" (tradename) commercially available from Beckman Coulter Inc.

Electrolyte Solution: "Isotone II" (tradename) commercially available from Beckman Coulter Inc.

Dispersing Solution:

A polyoxyethylene lauryl ether "EMULGEN 109P" (tradename) (HLB: 13.6) commercially available from Kao Corporation, was dissolved in the above electrolyte solution to prepare a dispersing solution having a concentration of 5% by weight.

Dispersing Conditions:

Ten milligrams of a toner sample to be measured were added to 5 mL of the above dispersing solution, and dispersed using an ultrasonic disperser for 1 min. Thereafter, 25 mL of the electrolyte solution were added to the resulting dispersion, and the obtained mixture was further dispersed using the ultrasonic disperser for 1 min to prepare a sample dispersion.

Measuring Conditions:

The thus prepared sample dispersion was added to 100 mL of the electrolyte solution, and after controlling a concentration of the resultant dispersion such that the measurement for particle sizes of 30,000 particles was completed within 20 s, the particle sizes of 30,000 particles were measured under such a concentration condition, and a volume median particle size ($D_{50}$) thereof was determined from the measured particle sizes.

Also, the CV as a particle size distribution of the particles was calculated from the volume-average particle size of the particles as determined by the above analyzing software and a standard deviation thereof according to the following formula:

$CV(\%)$=(Standard Deviation of Particle Size Distribution/Volume Average Particle Size)×100.

The volume median particle size of the aggregated particles (1) or the aggregated particles (2) was measured by the same method as used above for measuring the volume median particle size of the toner (particles) except for using the dispersion of the aggregated particles as the sample dispersion.

[Circularity of Toner]

The dispersion of a toner was prepared as follows. That is, 50 mg of the toner were added to 5 mL of a 5 wt % aqueous solution of polyoxyethylene lauryl ether "EMULGEN 109P" (tradename) available from Kao Corporation, and the resulting dispersion was dispersed using an ultrasonic disperser for 1 min. Thereafter, 20 mL of distilled water were added to the resulting dispersion, and the obtained mixture was further dispersed using the ultrasonic disperser for 1 min to prepare the dispersion of the toner.

Measuring Apparatus: Flow-type particle image analyzer "FPIA-3000" (tradename) available from Sysmex Corporation.

Measuring Mode: HPF measuring mode

[Evaluation of Low-Temperature Fusing Property of Toner]

A solid image was outputted and printed on a wood-free paper "J Paper" available from Fuji Xerox Co., Ltd.; size: A4 using a commercially available printer "ML 5400" (tradename) available from Oki Data Corporation. The solid image thus outputted was an unfused solid image having a length of 50 mm which was printed on the above A4 paper except for its top margin extending 5 mm from a top end thereof such that an amount of the toner deposited on the paper was from 0.42 to 0.48 mg/cm$^2$.

Next, the thus obtained unfused solid image on the paper was fixed by passing the paper through the same printer mounted with a fuser which was modified so as to variably control its fusing temperature. Upon fusing, the temperature of the fuser was adjusted to 100° C., and the fusing speed thereof was adjusted to 1.5 s per sheet in a longitudinal direction of the A4 paper, thereby obtaining a printed paper.

In addition, the same fusing procedure was repeated while increasing the fusing temperature of the fuser at intervals of 5° C., thereby obtaining printed papers having a fixed solid image.

A mending tape "Scotch Mending Tape 810" (tradename) available from 3M; width: 18 mm was cut into a length of 50 mm and lightly attached to a portion of the respective printed papers so as to extend from its top margin above an upper end of the solid image to the solid image-formed portion. Then, a weight of 500 g was rested on the tape and moved over the tape by one reciprocative motion at a speed of 10 mm/s while being kept in press-contact with the tape. Thereafter, the attached tape was peeled off from its lower end side at a peel angle of 180° and a peel speed of 10 mm/s, thereby obtaining the printed papers from which the tape had been peeled off. Before attaching the tape to the printed paper and after peeling-off the tape therefrom, each of the printed papers was placed on 30 sheets of a wood-free paper "EXCELLENT WHITE PAPER" (size: A4) available from Oki Data Coporation, to measure a reflection image density of the fused image portion thereof using a colorimeter "SpectroEye" (tradename) available from GretagMacbeth, under the light irradiating conditions including a standard light source $D_{50}$ and an observation visual field of 2° according to the density standard DINNB based on an absolute white color. The fusing rate of the toner was calculated from the thus measured reflection image density values according to the following formula.

Fusing Rate=(Reflection Image Density after Peeling-off Tape/Reflection Image Density before Attaching Tape)×100

The temperature at which the fusing rate first reached 90% or more was defined as a lowest fusing temperature. The lower the lowest fusing temperature, the more excellent the low-temperature fusing property of the toner becomes.

[Tribocharge of Toner under Normal-Temperature and Normal-Humidity Environmental Conditions (NN Tribocharge)]

A 50 mL cylindrical polypropylene bottle available from Nikko Hansen & Co., Ltd., was charged with 2.1 g of a toner and 27.9 g of a silicone ferrite carrier (available from Kanto Denka Kogyo Co., Ltd.; average particle size: 40 μm) at 25° C. and 50% RH, and the contents of the bottle were shaken 10 times in each of vertical and horizontal directions. Thereafter, the resulting mixture was mixed by a ball mill for 1 hour to measure a tribocharge of the toner using a q/m-meter available from Epping GmbH. The tribocharge thus measured was defined as a "tribocharge of the toner under normal-temperature and normal-humidity environmental conditions (NN tribocharge)". The higher the absolute value of the tribocharge of the toner, the more excellent the charging property of the toner becomes.

Meanwhile, a measuring device, measuring conditions set, etc., were as follows.

Measuring Device: "q/m-meter" available from Epping GmbH.

Measuring Conditions Set: mesh size: 635 meshes (opening: 24 μm; stainless steel screen); soft blow: blow pressure (600 V)

Suction Time: 90 s

Tribocharge (μC/g)=(Total Electricity (μC) after 90 s)/(Amount (g) of Toner Sucked)

[Tribocharge of Toner under High-Temperature and High-Humidity Environmental Conditions (HH Tribocharge) and Retention Rate of Tribocharge]

The toner after subjected to the above evaluation for charging property under the normal-temperature and normal-humidity environmental conditions was placed under the conditions of an ambient temperature of 30° C. and a relative humidity of 85% (under high-temperature and high-humidity environmental conditions), and allowed to stand under the conditions for 12 hours. Thereafter, the environmental conditions under which the toner was placed was changed from the high-temperature and high-humidity environmental conditions to the conditions of 25° C. and 50% RH, and the toner was stirred by a ball mill for 1 min under the latter conditions to measure a tribocharge of the toner by the same method as used above for evaluating the charging property under the normal-temperature and normal-humidity environmental conditions. The tribocharge thus measured was defined as a "tribocharge of the toner under high-temperature and high-humidity environmental conditions (HH tribocharge)". The higher the absolute value of the tribocharge, the more excellent the charging property of the toner becomes.

The retention rate of the tribocharge of the toner was calculated from the thus measured tribocharge values according to the following formula. The higher the retention rate of the tribocharge of the toner, the more excellent the charging property of the toner becomes.

Retention Rate of Tribocharge [%]=[(Tribocharge under High-Temperature High-Humidity Environmental Conditions)/(Tribocharge under Normal-Temperature Normal-Humidity Environmental Conditions)]×100

PRODUCTION EXAMPLE 1

Production of Non-Crystalline Polyester (1)

An inside atmosphere of a four-necked flask equipped with a nitrogen inlet tube, a dehydration tube, a stirrer and a thermocouple was replaced with nitrogen, and 1,750 g of polyoxypropylene (2.2)-2,2-bis(4-hydroxyphenyl)propane, 1,625 g of polyoxyethylene (2.0)-2,2-bis(4-hydroxyphenyl) propane, 1,145 g of terephthalic acid, 161 g of dodecenylsuccinic anhydride, 480 g of trimellitic anhydride and 10 g of dibutyl tin oxide were charged into the flask. The contents of the flask were heated to 220° C. in a nitrogen atmosphere while stirring and maintained at 220° C. for 5 hours. Thereafter, after confirming that the softening point of the contents of the flask reached 120° C. as measured according to ASTM D36-86, the contents of the flask were cooled to terminate a reaction thereof, thereby obtaining a non-crystalline polyester (1). As a result, it was confirmed that the resulting non-crystalline polyester (1) had a glass transition point of 65° C., a softening point of 122° C., a crystallinity index of 1.6, an acid value of 21.0 mgKOH/g and a number-average molecular weight of $2.9\times10^3$.

PRODUCTION EXAMPLE 2

Production of Non-Crystalline Polyester (2)

An inside atmosphere of a four-necked flask equipped with a nitrogen inlet tube, a dehydration tube, a stirrer and a thermocouple was replaced with nitrogen, and 3,374 g of polyoxypropylene (2.2)-2,2-bis(4-hydroxyphenyl)propane, 33 g of polyoxyethylene (2.0)-2,2-bis(4-hydroxyphenyl)propane, 672 g of terephthalic acid and 10 g of dibutyl tin oxide were charged into the flask. The contents of the flask were heated to 230° C. in a nitrogen atmosphere while stirring and maintained at 230° C. for 5 hours, and then the pressure within the flask was reduced and maintained under 8.3 kPa for 1 hour. Thereafter, the contents of the flask were cooled to 210° C. The pressure within the flask was returned to atmospheric pressure, and then 696 g of fumaric acid and 0.49 g of 4-tert-butyl catechol were added to the flask. The contents of the flask were maintained at 210° C. for 5 hours, and then the pressure within the flask was reduced and maintained under 8.3 kPa for 4 hours, thereby obtaining a non-crystalline polyester (2). As a result, it was confirmed that the resulting non-crystalline polyester (2) had a glass transition point of 65° C., a softening point of 107° C., a crystallinity index of 1.5, an acid value of 24.4 mgKOH/g and a number-average molecular weight of $3.0\times10^3$.

PRODUCTION EXAMPLE 3

Production of Dispersion of Colorant-Containing Resin Particles (A) (Resin Particle Dispersion A)

A 5 L-capacity flask was charged with 210 g of the non-crystalline polyester (1), 390 g of the non-crystalline polyester (2), 45 g of a copper phthalocyanine pigment "ECB-301" (tradename) available from Dainichiseika Color & Chemicals Mfg. Co., Ltd, 6 g of a polyoxyethylene alkyl ether (nonionic surfactant; "EMULGEN 430" (tradename) available from Kao Corporation), 40 g of a 15 wt % aqueous solution of sodium dodecylbenzenesulfonate (anionic surfactant; "NEOPELEX G-15" (tradename) available from Kao Corporation), and 268 g of a 5 wt % potassium hydroxide aqueous solution, and the contents of the flask were heated to 95° C. while stirring and melted, and further mixed at 95° C. for 2 hours, thereby obtaining a resin mixture.

Then, while stirring, 1,146 g of deionized water were added dropwise into the flask at a rate of 6 g/min to prepare an emulsion. Next, the obtained emulsion was cooled to 25° C. and passed through a wire mesh having a 200 mesh screen (opening: 105 μm) to obtain a dispersion of colorant-containing resin particles (A) (resin particle dispersion A). The solid content of the thus obtained dispersion was 32% by weight, and the resin particles (A) in the dispersion A had a glass transition point of 61° C., a volume median particle size of 0.180 μm and a CV of 28%.

PRODUCTION EXAMPLE 4

Production of Dispersion of Non-Crystalline Polyester-Containing Resin Particles (B) (Resin Particle Dispersion B)

A 5 L-capacity flask as a reactor was charged with 210 g of the non-crystalline polyester (1), 390 g of the non-crystalline polyester (2), 6 g of a polyoxyethylene alkyl ether (nonionic surfactant; "EMULGEN 430" (tradename) available from Kao Corporation), 40 g of a 15 wt % aqueous solution of sodium dodecylbenzenesulfonate (anionic surfactant; "NEOPELEX G-15" (tradename) available from Kao Corporation), and 268 g of a 5 wt % potassium hydroxide aqueous solution, and the contents of the flask were heated to 95° C. while stirring and melted, and further mixed at 95° C. for 2 hours, thereby obtaining a resin mixture.

Then, while stirring, 1,145 g of deionized water were added dropwise into the flask at a rate of 6 g/min to prepare an emulsion. Next, the obtained emulsion was cooled to 25° C. and passed through a wire mesh having a 200 mesh screen. Then, deionized water was added to the emulsion to adjust a solid content thereof to 23% by weight, thereby obtaining a dispersion of non-crystalline polyester-containing resin particles (B) (resin particle dispersion B). The resin particles (B) in the dispersion B had a glass transition point of 60° C., a volume median particle size of 0.158 μm and a CV of 24%.

PRODUCTION EXAMPLE 5

Production of Dispersion of Releasing Agent Particles

A 1 L-capacity beaker was charged with 480 g of deionized water, 4.29 g of an aqueous solution of dipotassium alkenyl (mixture of hexadecenyl group and octadecenyl group) succinate "LATEMUL ASK" (tradename) available from Kao Corporation; concentration of effective ingredients: 28% by weight, and 120 g of a carnauba wax, available from S. Kato & Co.; melting point: 85° C.; acid value: 5 mgKOH/g), and the contents of the beaker were stirred. While maintaining the resulting mixed solution at a temperature of 90 to 95° C., the mixed solution was subjected to dispersing treatment for 30 min using an ultrasonic disperser "Ultrasonic Homogenizer 600W" (tradename) available from Nippon Seiki Co., Ltd.), and then cooled to 25° C. Then, deionized water was added to the resulting dispersion to adjust a solid content of the dispersion to 20% by weight, thereby obtaining a dispersion of releasing agent particles. The resulting releasing agent particles had a volume median particle size of 0.494 nm and a CV of 34%.

EXAMPLE 1

Production of Toner A

A 2 L-capacity four-necked flask equipped with a dehydration tube, a stirrer and a thermocouple was charged with 250 g of the resin particle dispersion A, 44 g of deionized water and 19 g of the dispersion of the releasing agent particles, and the contents of the flask were mixed with each other at 25° C. Then, while stirring the resulting mixture at 25° C., an aqueous solution prepared by dissolving 1.01 g of ethylenediamine dihydrochloride in 134 g of deionized water was added dropwise to the mixture over 30 min. The resulting mixed solution was heated to 50° C. and maintained at 50° C., thereby obtaining a dispersion containing aggregated particles (1) having a volume median particle size of 3.9 μm.

Subsequently, a mixed solution prepared by mixing 22 g of the resin particle dispersion B and 7.0 g of deionized water was added dropwise to the thus obtained dispersion containing the aggregated particles (1) over 60 min, and thereafter the same mixed solution was further prepared and added dropwise to the resulting dispersion over 60 min. Further, the same mixed solution was prepared and added dropwise to the above dispersion over 60 min. Next, after heating the resulting mixed dispersion to 52° C., a mixed solution prepared by mixing 22 g of the resin particle dispersion B and 7.0 g of deionized water was added dropwise thereto over 60 min. Thereafter, the same mixed solution was prepared and added dropwise to the resulting dispersion over 60 min. As a result, a dispersion containing aggregated particles (2) having a volume median particle size of 5.5 μm was obtained.

An aqueous solution prepared by mixing 18.8 g of sodium polyoxyethylene laurylethersulfate "EMAL E-27C" (tradename) available from Kao Corporation; solid content: 28% by weight, and 1,483 g of deionized water was added to the thus obtained dispersion containing the aggregated particles (2). Then, the resulting dispersion was heated to 65° C. over 2 hours, and then maintained at 65° C. for 3 hours, thereby obtaining core/shell particles having a volume median particle size of 5.5 μm.

The resulting dispersion of the core/shell particles was cooled to 25° C., and successively subjected to filtration, drying and rinsing, thereby obtaining toner particles. Next, 2.5 parts by weight of a hydrophobic silica "RY50" (tradename) available from Nippon Aerosil Co., Ltd.; number-average particle size: 0.04 μm, 1.0 part by weight of a hydrophobic silica "CAB-O-SIL TS-720" (tradename) available from Cabot Corporation; number-average particle size: 0.012 μm and 0.8 part by weight of polymer fine particles "FINESPHERE P2000" (tradename) available from Nippon Paint Co., Ltd.; number-average particle size: 0.5 μm were externally added to 100 parts by weight of the toner particles using a Henschel mixer. The resulting mixture was then allowed to pass through a 150 mesh sieve, thereby obtaining a toner A for development of electrostatic latent images. Properties and evaluation results of the thus obtained toner A are shown in Table 1.

EXAMPLE 2

Production of Toner B

The same procedure as in Example 1 was repeated except that the aqueous solution of ethylenediamine dihydrochloride was replaced with an aqueous solution of hexamethylenediamine dihydrochloride prepared by dissolving 1.2 g of hexamethylenediamine dihydrochloride in 107 g of deionized water, thereby obtaining a toner B. Properties and evaluation results of the thus obtained toner B are shown in Table 1.

EXAMPLE 3

Production of Toner C

The same procedure as in Example 1 was repeated except that the aqueous solution of ethylenediamine dihydrochloride was replaced with an aqueous solution of ethylenediamine dihydrochloride prepared by dissolving 2.05 g of ethylenediamine dihydrochloride in 137 g of deionized water, thereby obtaining a toner C. Properties and evaluation results of the thus obtained toner C are shown in Table 1.

EXAMPLE 4

Production of Toner D

The same procedure as in Example 1 was repeated except that 44 g of deionized water to be first charged into the 2 L-capacity four-necked flask in Example 1 was replaced with 11 g of a 15 wt % aqueous solution of sodium dodecylbenzenesulfonate (anionic surfactant; "NEOPELEX G-15" (tradename) available from Kao Corporation) and 35 g of deionized water, and the aqueous solution of ethylenediamine dihydrochloride was replaced with an aqueous solution of tetraethylenepentamine pentahydrochloride prepared by dissolving 1.8 g of tetraethylenepentamine pentahydrochloride in 290 g of deionized water, thereby obtaining a toner D. Properties and evaluation results of the thus obtained toner D are shown in Table 1.

EXAMPLE 5

Production of Toner E

The same procedure as in Example 1 was repeated except that the aqueous solution of ethylenediamine dihydrochloride was replaced with an aqueous solution of piperazine dihydrochloride prepared by dissolving 1.3 g of piperazine dihydrochloride in 98 g of deionized water, thereby obtaining a toner E. Properties and evaluation results of the thus obtained toner E are shown in Table 1.

COMPARATIVE EXAMPLE 1

Production of Toner F

The same procedure as in Example 1 was repeated except that the aqueous solution of ethylenediamine dihydrochloride was replaced with an ammonium sulfate aqueous solution prepared by dissolving 19.4 g of ammonium sulfate in 219 g of deionized water, thereby obtaining a toner F. Properties and evaluation results of the thus obtained toner F are shown in Table 1.

COMPARATIVE EXAMPLE 2

Production of Toner G

The same procedure as in Example 1 was repeated except that the aqueous solution of ethylenediamine dihydrochloride was replaced with a magnesium sulfate aqueous solution prepared by dissolving 0.97 g of magnesium sulfate in 134 g of deionized water, thereby obtaining a toner G. Properties and evaluation results of the thus obtained toner G are shown in Table 1.

COMPARATIVE EXAMPLE 3

Production of Toner H

The same procedure as in Example 1 was repeated except that the aqueous solution of ethylenediamine dihydrochloride was replaced with a polyethyleneimine aqueous solution prepared by dissolving 1.0 g of polyethyleneimine "EPOMIN SP-012" (tradename) available from Nippon Shokubai Co., Ltd.; number-average molecular weight: 1,200; valence: 23 in 220 g of deionized water. After adding dropwise the polyethyleneimine aqueous solution and stirring the obtained mixture for 30 min, the resulting mixed solution was heated to 50° C. However, the obtained aggregated particles became too coarse, thereby failing to obtain a toner.

COMPARATIVE EXAMPLE 4

Production of Toner I

The same procedure as in Example 1 was repeated except that the aqueous solution of ethylenediamine dihydrochloride was replaced with a potassium chloride aqueous solution prepared by dissolving 22.5 g of potassium chloride in 206 g of deionized water, thereby obtaining a toner I. Properties and evaluation results of the thus obtained toner I are shown in Table 1.

TABLE 1-1

| | | | Examples | | | | |
|---|---|---|---|---|---|---|---|
| | | | 1 | 2 | 3 | 4 | 5 |
| Aggregating agent | Organic compound | Kind | *1) | *2) | *1) | *3) | *4) |
| | | Valence of cation in a molecule | 2 | 2 | 2 | 5 | 2 |
| | | Molecular weight | 133 | 189 | 133 | 372 | 177 |
| | Inorganic compound | Kind | | | | | |
| | | Valence of cation | | | | | |
| | | Molecular weight | | | | | |
| | Amount of aggregating agent based on resin particles (wt %) | | 1.3 | 1.5 | 2.6 | 2.3 | 1.7 |
| Evaluation of toner | Toner No. | | A | B | C | D | E |
| | Circularity | | 0.965 | 0.963 | 0.961 | 0.960 | 0.962 |
| | Softening point [° C.] | | 110 | 111 | 111 | 111 | 110 |
| | Low-temperature fusing property: lowest fusing temperature [° C.] | | 140 | 140 | 140 | 140 | 140 |
| | Charging property: retention rate of tribocharge HH/NN [%] | | 72 | 68 | 63 | 65 | 70 |
| | NN tribocharge [μC/g] | | 43 | 44 | 46 | 43 | 40 |
| | HH tribocharge [μC/g] | | 31 | 30 | 29 | 28 | 28 |

TABLE 1-1-continued

| | | | Comparative Examples | | | |
|---|---|---|---|---|---|---|
| | | | 1 | 2 | 3 | 4 |
| Aggregating agent | Organic compound | Kind | | | Polyethyleneimine | |
| | | Valence of cation in a molecule | | | 23 | |
| | | Molecular weight | | | 1200 | |
| | Inorganic compound | Kind | Ammonium sulfate | Magnesium sulfate | | Potassium chloride |
| | | Valence of cation | 1 | 2 | | 1 |
| | | Molecular weight | 132 | 120 | | 75 |
| | Amount of aggregating agent based on resin particles (wt %) | | 24.3 | 1.2 | 1.3 | 19.0 |
| Evaluation of toner | Toner No. | | F | G | H | I |
| | Circularity | | 0.957 | 0.963 | No toner was obtained | 0.954 |
| | Softening point [° C.] | | 110 | 119 | | 113 |
| | Low-temperature fusing property: lowest fusing temperature [° C.] | | 140 | 155 | | 145 |
| | Charging property: retention rate of tribocharge HH/NN [%] | | 47 | 71 | | 47 |
| | NN tribocharge [μC/g] | | 36 | 38 | | 43 |
| | HH tribocharge [μC/g] | | 17 | 27 | | 20 |

Note
*1): Ethylenediamine dihydrochloride;
*2) Hexamethylenediamine dihydrochloride;
*3): Tetraethylenepentamine pentahydrochloride;
*4): Piperazine dihydrochloride From Table 1, it was confirmed that the toners for development of electrostatic latent images obtained in Examples 1 to 5 by the process for producing a toner for development of electrostatic latent images according to the present invention were excellent in both of low-temperature fusing property and charging property.

Industrial Applicability

According to the production process of the present invention, there can be provided a toner for development of electrostatic latent images which is excellent in low-temperature fusing property and charging property. The toner for development of electrostatic latent images obtained according to the present invention can be used as a one-component system developer, or can be mixed with a carrier to form a two-component system developer.

The invention claimed is:

1. A process for producing a toner for development of electrostatic latent images, comprising mixing and aggregating resin particles (A), releasing agent particles and an aggregating agent formed of a divalent to pentavalent amine salt in an aqueous medium to obtain aggregated particles (1), wherein the resin particles (A) comprise a polyester resin (a).

2. The process for producing a toner for development of electrostatic latent images according to claim 1, wherein the amine salt has a molecular weight of from 100 to 1,000.

3. The process for producing a toner for development of electrostatic latent images according to claim 1, wherein a valence of the amine contained in the amine salt is 2 or 3.

4. The process for producing a toner for development of electrostatic latent images according to claim 1, wherein the amine salt is at least one compound selected from the group consisting of ethylenediamine dihydrochloride, hexamethylenediamine dihydrochloride, tetraethylenepentamine pentahydrochloride and piperazine dihydrochloride.

5. The process for producing a toner for development of electrostatic latent images according to claim 1, wherein, in said mixing and aggregating, the aggregating agent is present in an amount of from 0.1 to 10 parts by weight on the basis of 100 parts by weight of the resins constituting the resin particles (A).

6. The process for producing a toner for development of electrostatic latent images according to claim 1, wherein the polyester resin (a) comprises a non-crystalline polyester in an amount of from 70 to 100% by weight.

7. The process for producing a toner for development of electrostatic latent images according to claim 1, wherein in said mixing and aggregating, a surfactant is added.

8. The process for producing a toner for development of electrostatic latent images according to claim 7, wherein the surfactant comprises a nonionic surfactant and an anionic surfactant, and a weight ratio of the nonionic surfactant to the anionic surfactant (nonionic surfactant/anionic surfactant) is from 0.3 to 10.

9. The process for producing a toner for development of electrostatic latent images according to claim 1, further comprising adding resin particles (B) comprising a polyester resin (b) to the aggregated particles (1) obtained in said mixing and aggregating to obtain aggregated particles (2).

10. The process for producing a toner for development of electrostatic latent images according to claim 9, wherein the polyester resin (b) is a non-crystalline polyester.

11. The process for producing a toner for development of electrostatic latent images according to claim 9, further comprising maintaining the aggregated particles (1) or the aggregated particles (2) at a temperature not lower than a glass transition point of the resin particles (A) to obtain fused particles.

12. The process for producing a toner for development of electrostatic latent images according to claim 11, wherein the temperature maintained in said maintaining is lower than a melting point of the releasing agent and not lower than a temperature lower by 10° C. than a glass transition point of the polyester resin (b).

13. The process for producing a toner for development of electrostatic latent images according to claim 11, wherein the temperature maintained in said maintaining is from 58 to 69° C.

14. The process for producing a toner for development of electrostatic latent images according to claim 1, wherein the amine salt is an amine acid salt which is a hydrochloride or a sulfate of an amine.

15. The process for producing a toner for development of electrostatic latent images according to claim 1, wherein the resin particles (A) comprise a colorant.

16. The process for producing a toner for development of electrostatic latent images according to claim 1, wherein the content of water in the aqueous medium is substantially 100% by weight.

17. The process for producing a toner for development of electrostatic latent images according to claim 1, wherein a polyester resin (a) comprises at least one polyester resin obtained with an acid component comprising a trivalent or higher-valent polycarboxylic acid or an anhydride or alkyl ester thereof.

18. The process for producing a toner for development of electrostatic latent images according to claim 9, wherein, in said adding, a dispersion of the resin particles (B) comprising the polyester resin (b) is added to a dispersion of the aggregated particles (1) obtained in said mixing and aggregating while gradually raising a temperature of the dispersion of the aggregated particles (1).

19. The process for producing a toner for development of electrostatic latent images according to claim 1, further comprising maintaining the aggregated particles (1) at a temperature not lower than a glass transition point of the resin particles (A) to obtain fused particles.

* * * * *